US006609644B1

(12) United States Patent
Menna

(10) Patent No.: US 6,609,644 B1
(45) Date of Patent: Aug. 26, 2003

(54) METHOD OF DISPENSING PERFORATED TICKETS

(75) Inventor: Louis P. Menna, Cranston, RI (US)

(73) Assignee: Instant Technologies, Inc., Framingham, MA (US)

( * ) Notice: Subject to any disclaimer, the term of this patent is extended or adjusted under 35 U.S.C. 154(b) by 0 days.

(21) Appl. No.: 09/394,659

(22) Filed: Sep. 13, 1999

Related U.S. Application Data

(63) Continuation of application No. 09/938,122, filed on Sep. 26, 1997, now Pat. No. 5,950,898.

(51) Int. Cl.[7] ..... B26F 3/00

(52) U.S. Cl. ..... 225/4; 225/104; 225/106

(58) Field of Search ..... 225/4, 5, 100, 225/101, 106; 101/66, 227, 226, 228; 400/621

(56) References Cited

U.S. PATENT DOCUMENTS

| | | | | | |
|---|---|---|---|---|---|
| 1,905,659 | A | * | 4/1933 | Thomson | 101/66 |
| 2,219,650 | A | * | 10/1940 | Helsel | 101/227 |
| 2,252,720 | A | * | 8/1941 | Metzner | 225/5 |
| 2,325,054 | A | * | 7/1943 | Helsel | 101/66 |
| 2,776,007 | A | | 1/1957 | Dietz et al. | |
| 2,970,784 | A | | 2/1961 | Kessler | |
| 3,481,520 | A | | 12/1969 | Pickering | |
| 3,794,228 | A | | 2/1974 | Colwill et al. | |
| 3,894,669 | A | | 7/1975 | Wescoat | |
| 4,094,451 | A | | 6/1978 | Wescoat | |
| 4,284,221 | A | | 8/1981 | Nagel et al. | |
| 4,397,410 | A | | 8/1983 | Schueler | |
| 4,515,321 | A | | 5/1985 | Kahlman | |
| 4,586,639 | A | | 5/1986 | Ruff et al. | |
| 4,688,708 | A | | 8/1987 | Irvine et al. | |
| 4,697,726 | A | * | 10/1987 | Gaucher | 225/5 |
| 4,730,762 | A | * | 3/1988 | Felix | 225/4 |
| 4,844,369 | A | * | 7/1989 | Kanayachi | 242/56 |
| 4,982,337 | A | * | 1/1991 | Burr et al. | |
| 5,133,615 | A | * | 7/1992 | Saito et al. | 101/227 |
| 5,160,076 | A | * | 11/1992 | Ford | |
| 5,215,383 | A | * | 6/1993 | Hilton | 400/621 |
| 5,312,031 | A | * | 5/1994 | Thelen et al. | 225/4 |
| 5,503,318 | A | * | 4/1996 | Chou | 101/66 |
| 5,540,369 | A | * | 7/1996 | Boreali et al. | 225/4 |
| 5,720,223 | A | * | 2/1998 | Meschi | 101/227 |
| 5,833,104 | A | * | 11/1998 | Horniak et al. | 225/106 |
| 5,836,498 | A | * | 11/1998 | Turek | 225/100 |
| 5,853,117 | A | * | 12/1998 | Traise | 225/4 |

* cited by examiner

*Primary Examiner*—M. Rachuba
*Assistant Examiner*—Kim Ngoc Tran
(74) *Attorney, Agent, or Firm*—Salter & Michaelson

(57) ABSTRACT

A lottery ticket dispensing machine includes a ticket dispensing mechanism for advancing a continuous strip of lottery tickets therethrough and subsequent separation of the selected number of tickets from the continuous strip. The machine includes a framing assembly for housing the dispensing mechanism which is controlled by a computer driven printed circuit board for determining the distance that the continuous strip of tickets will travel. The dispensing mechanism is powered by a motor for rotation of a set of pinch rollers and forward feed advancement of the continuous strip of lottery tickets therethrough. The strip of tickets travels past a stationary cutting blade subsequently hitting a deflector cover for directing the strip of tickets in an opposite direction until reaching the pre-set distance generated by the printed circuit board at which point the motor reverses and the first encountered perforation engages the stationary cutting blade for separation of the selected number of tickets from the continuous strip.

11 Claims, 8 Drawing Sheets

METHOD OF DISPENSING PERFORATED TICKETS

This application is a continuation of Ser. No. 09/938,122 filed Sep. 26, 1997, now U.S. Pat. No. 5,950,898.

BACKGROUND AND SUMMARY OF THE INVENTION

This invention relates generally to lottery ticket dispensing machines, and more particularly to an automated vending machine for dispensing a predetermined number of instant scratch lottery tickets. Specifically, the vending machine includes a dispensing mechanism which accepts a continuous strip of instant scratch lottery tickets perforated at intervals and separates a predetermined number of the tickets from the continuous strip according to the ticket selection and corresponding computer generated command.

Although it is widely believed that lotteries are a recent phenomenon, history tells us that lotteries have been around for quite some time now. One form or another of the lottery has been present dating back to the mid-18$^{th}$ century. For example, there is evidence of the lottery being active with the pharaohs of Egypt. Keno, now a video form of the lottery, is over 3,000 years old and was first played in China to help fund the building of The Great Wall. El Gordo, Spain's most popular lotto game, was established in 1763 and is the oldest continually operating lottery game in the world. The lottery also has a relatively lengthy history in North America. For example, Ivy league private universities such as Harvard, Yale, and Brown were helped to be built with lottery revenues. Further, the Revolutionary war was partially funded with lottery revenues.

Presently, consumer support for the lottery is at an all time high. It has been 32 years since the inaugural New Hampshire sweepstakes and the lotteries have now grown to serve more than 210 million Americans, some 80% of the nation's population. Today, there are two basic types of lotteries, the instant scratch off ticket and on-line gaming. Instant games enable the player to scratch off a masked area on the ticket to immediately reveal the game result and prize. On-line lotteries allow participants to select a number which will be a winner if all or part of it matches numbers selected in a scheduled drawing. On-line lotteries are, by far, the most popular, accounting for nearly 75% of the worldwide lottery. Recently, with the innovation of faster on-line games, the distinction between the two categories has blurred, and other forms of lottery are emerging. For example, video lotteries are also demonstrating popularity, particularly among younger players who are drawn to technology and style of play. Other lottery forms include: Lotto, a different form of on-line gaming; Power Ball, now played in 21 states offering one of the bigger prize rewards; Numbers; Keno, a form of video or televised gaming; Customized games, for particular preferences for different regions of the country or world; Instant games, for people who want to know if they are immediately a winner or loser; Video lottery and Televised lottery.

According to a recent survey conducted by one of the largest lottery companies in the business, Americans approve of legalized gaming by a 2 to 1 margin. Some of the reasons for such widespread approval reside in the many benefits that the lottery are believed to create. For example, the lottery is believed to create jobs and to be an acceptable form of entertainment. Also, legalized gaming is believed to keep taxes lower because a portion of its revenue is returned to the government which helps finance such things as education, health and public works projects in communities where the games are being played. A rough breakdown on how the lottery revenue is believed to be distributed is as follows: 50% prizes to the winners; 35% to civic gain as mentioned above; 12% to the lottery administration; and 3% to the lottery system operations.

The instant invention is directed to lottery vending machines for dispensing instant scratch lottery tickets of the kind described above. The machines are effective for dispensing tickets which are perforated at intervals determined by the type of scratch game. The ticket intervals can be anywhere from 2 inches up to 16 inches. When a ticket selection is made, a printed circuit board activates the dispensing mechanism of the instant invention for dispensing the selected number of tickets. The vending machines are distributed to a variety of different public or private locations which desire to have access to instant scratch lottery tickets of the kind described above. The vending machines provide for a different sales outlet for the lottery tickets compared to the traditional outlets such as a gas station or a convenient store.

The instant invention relates to an automated vending machine for dispensing instant scratch lottery tickets perforated at intervals in a continuous strip. The vending machine comprises a framing assembly for housing a dispensing mechanism comprising the instant invention. A computer driven printed circuit board is further housed within the framing assembly for determining the distance that the continuous strip of tickets will travel, which distance corresponds to the number of tickets that will be selectively dispensed. The dispensing mechanism comprises a motor which is operated by the printed circuit board for driving a drive gear which meshes with a driven gear for rotation of a first pinch roller whereby the first pinch roller cooperates with a second pinch roller for advancing the continuous strip of tickets forward through feed guides and between said pinch rollers past a stationary cutting blade, subsequently hitting a deflector cover for directing the strip of tickets in the opposite direction until it reaches the pre-set distance generated by the printed circuit board. At this point, the motor reverses and the strip of tickets travel backward so that the first perforation engages the apex of the stationary cutting blade for separation of the selected number of tickets from the continuous strip whereby the tickets drop out of the vending machine and the dispensing mechanism returns to a home position. A pair of optic sensors are strategically mounted on support plates of the dispensing mechanism for detecting the leading edge of the lottery tickets and communicating the same to the printed circuit board for corresponding operation of the motor in either the forward or backward direction.

Accordingly among the several objects of the instant invention are: the provision of a lottery vending machine for dispensing a selected number of instant scratch lottery tickets; the provision of a lottery vending machine which may be selectively located at any desirable public or private location; the provision of a lottery vending machine which houses a specially constructed automated dispensing mechanism; the provision of such a dispensing mechanism having a stationary cutting blade for pull separating the selected number of tickets from the continuous strip; and the provision of a lottery vending machine which is cost effective to manufacture and easy to use.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
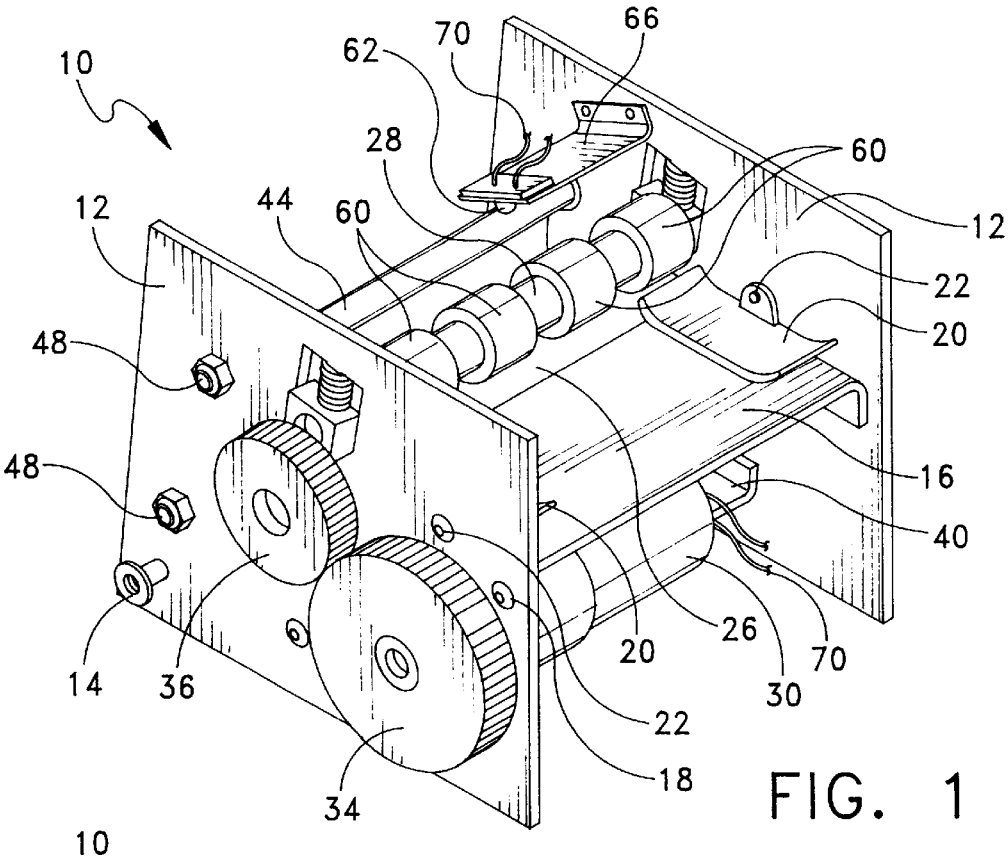
FIG. 1 is a perspective view of the ticket dispensing mechanism of the instant invention.

Referring now to the drawings and more particularly to FIG. 1 the ticket dispensing mechanism of the instant invention is shown and generally indicated at 10. As will hereinafter be more fully described, the instant invention is operable for dispensing a predetermined number of instant scratch lottery tickets from a vending machine.

Referring to FIGS. 1–4, the dispensing mechanism of the instant invention 10 includes a pair of oppositely positioned parallel support plates 12, each plate having a threaded bushing 14 mounted therein for attaching the mechanism 10 within the frame of a vending machine (not shown). The support plates provide a brace between which the components of the dispensing mechanism may be mounted. A horizontally disposed platen 16 is mounted by screws 18 to the vertical support plates 12 and runs perpendicularly therebetween. A pair of feed guides 20 are fixedly attached by screws 22 to the vertically disposed support plates 12 and run generally parallel to the horizontal platen 16 leaving a small gap between the bottom surface of the feed guides 20 and the top surface of the platen 16 for guiding insertion of a continuous strip of instant scratch lottery tickets 24. The dispensing mechanism 10 further includes a pair of gear driven pinch rollers 26 and 28 which run transversely across vertically disposed support plates 12. Specifically, a motor 30 is mounted to one of the support plates 12 beneath the horizontal platen 16. The motor 30 is controlled by a computer driven printed circuit board (not shown) and drives a gear shaft 32 which operates a gear drive wheel 34. The drive gear 34 meshes with a driven gear 36 for rotation of a pinch roller shaft 38 which rotates the first pinch roller 26. A second pinch roller 28 is adjacently mounted above the first pinch roller 26 and engages same for rotation of each roller 26 and 28 in opposite directions. Further mounted between the vertically disposed support plates 12 is a cutting blade plate 40 which runs in substantially the same general plane as does the vertical support plates 12. A stationary cutting blade 42 is screw mounted to the cutting blade plate 40 adjacent the pinch rollers 26 and 28 and a deflector cover 44 is threadably mounted between the vertically disposed support plates 12 adjacent the cutting blade 42 by a pair of threadable rods 46 and releasably held therebetween by nuts 48.

Figure 2:
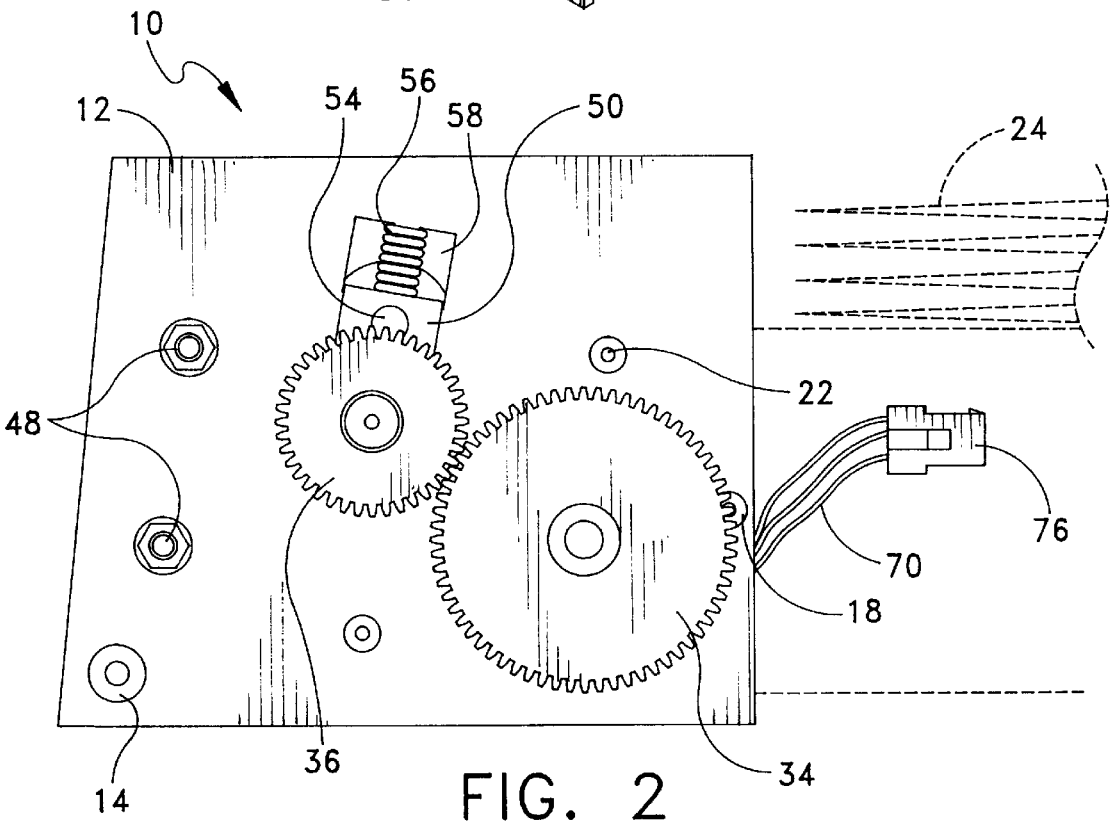
FIG. 2 is a side view thereof.
Figure 3:
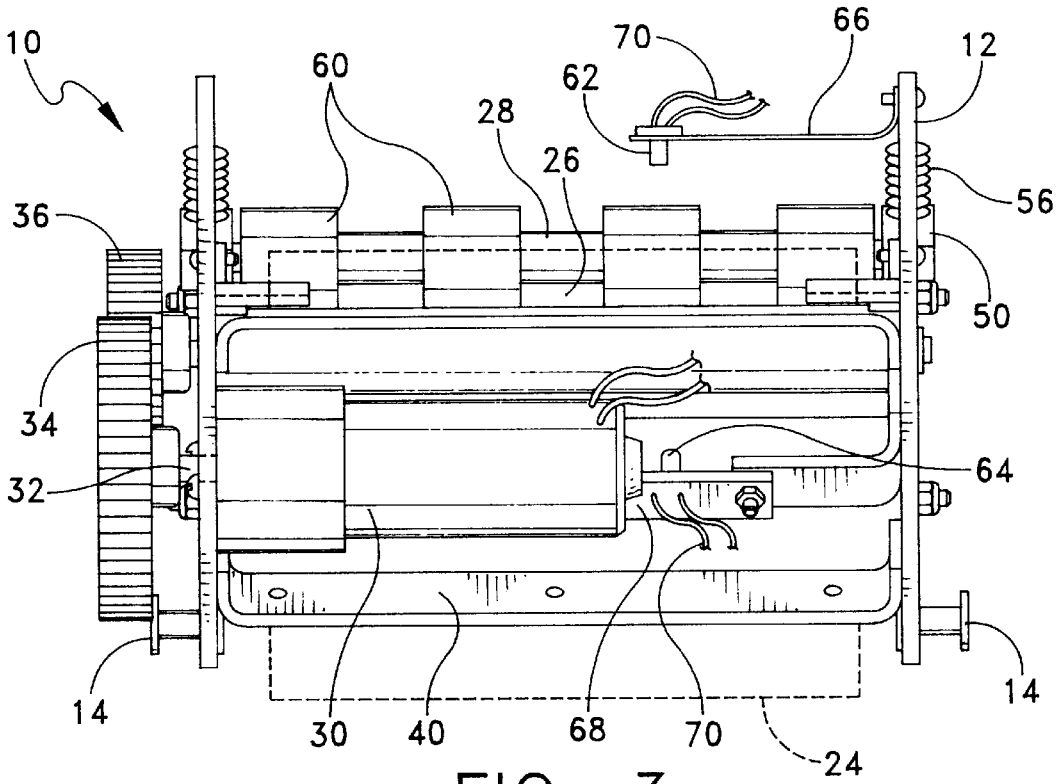
FIG. 3 is a front view thereof.
Figure 4:
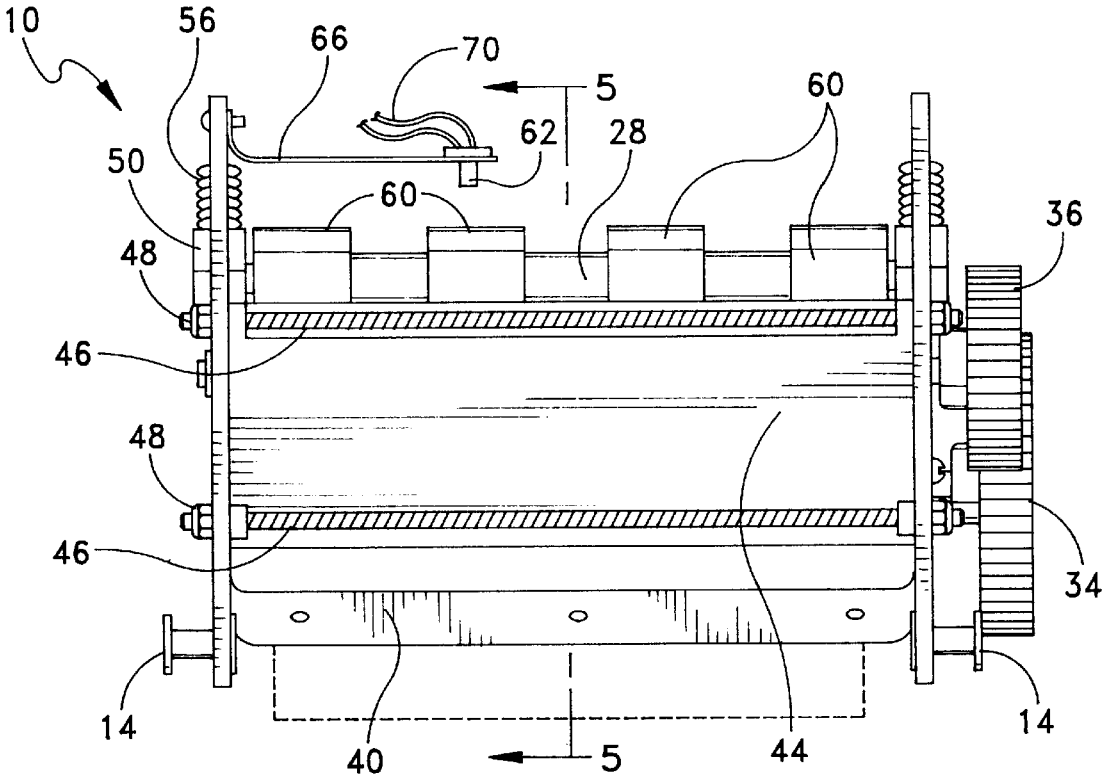
FIG. 4 is a rear view thereof.

As most clearly depicted in FIGS. 1–2 the second pinch roller 28 is mounted between support plates 12 by a pair of delron blocks each indicated at 50. Specifically, the delron blocks 50 receive opposite ends of the shaft 52 of the second pinch roller 28 in correspondingly shaped circular openings 54. The arrangement is such that the shaft 52 of the second pinch roller 28 rotates within the openings 54 located in each delron block 50. Each delron block 50 is fitted by a spring 56 within corresponding square shape openings 58 in oppositely positioned support plates 12. The second pinch roller 28 further has four roller pads, each indicated at 60, mounted therearound for engagement with the first pinch roller 26 when the motor 30 drives the gears 34 and 36. Also shown in the figures, and more particularly in FIGS. 1 and 3, are a pair of optic sensors 62 and 64. One of the optic sensors 62 is mounted on a bracket 66 which extends from the vertical support plate 12 and the other sensor 64 is mounted on a bracket 68 which extends from the cutting blade plate 40 adjacent the motor 30. The sensors 62 and 64 are operable for detecting the leading edge of the lottery tickets 24 and sending a corresponding signal to the motor 30 for operation of the dispensing mechanism 10 in either a forward or backward direction. As best shown in FIG. 2, a set of wires 70 extend from each optic sensor 62 and 64 and a set of wires 70 extend from the motor 30 which terminate in a plug 76 for powering the dispensing mechanism 10. As previously mentioned, a printed circuit board (not shown) operates the motor 30 and optic sensors 62 and 64.

Figure 5:
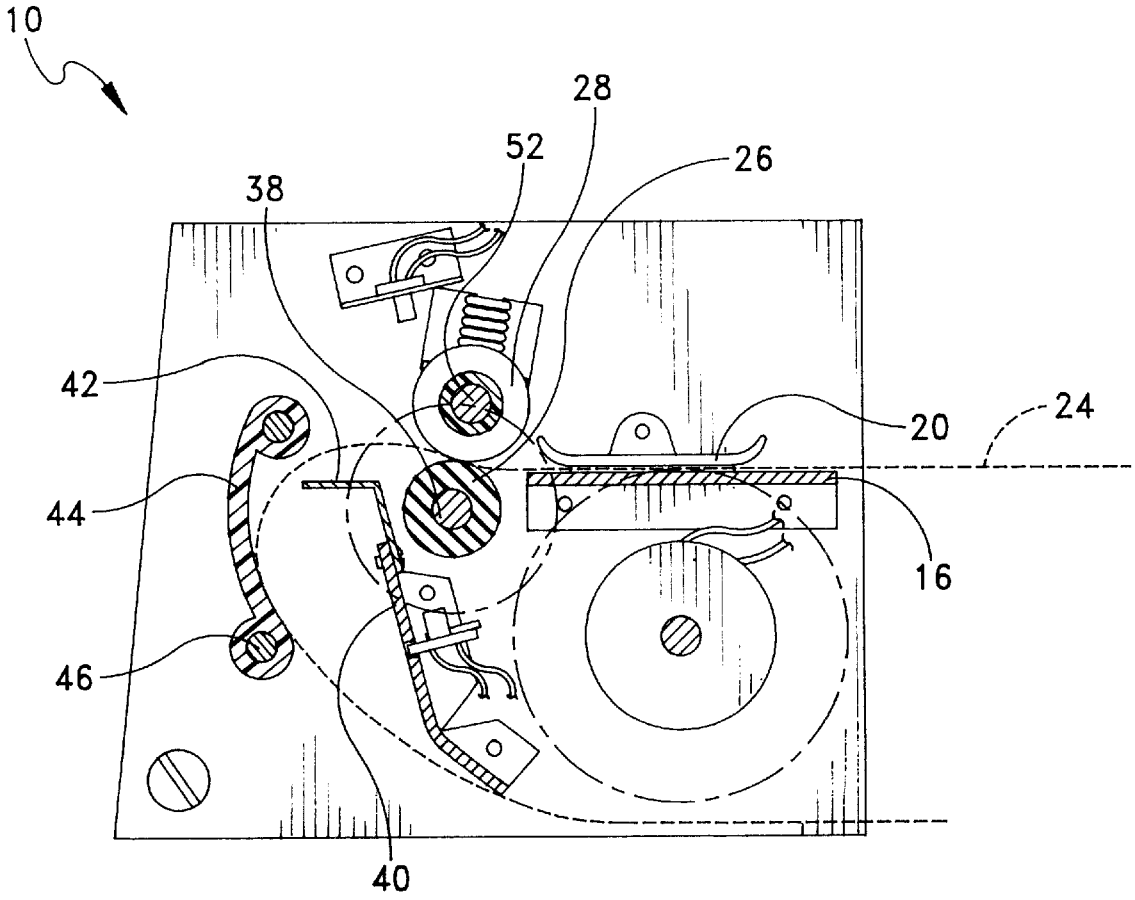
FIG. 5 is a cross-sectional view taken along line 5—5 of FIG. 4 showing a continuous strip of lottery tickets advanced through the mechanism of the instant invention.

Referring now to FIGS. 5–8 the progression of operation of the ticket dispensing mechanism of the instant invention 10 is shown in a series of steps. Referring first to FIG. 5, the strip of lottery tickets 24 is depicted, in broken lines, traveling through the dispensing mechanism. Specifically, the leading edge of the strip of lottery tickets 24 is fed over the top surface of the horizontal platen 16 and under the feed guides 20 where the strip 24 enters between the pinch rollers 26 and 28 and is fed therethrough by operation of the motor 30 and rotation of the pinch roller shafts 38 and 52. The strip 24 is then advanced over the stationary cutting blade 42 which extends generally perpendicular from the cutting blade plate 40 and contacts the deflector cover 44 continuing forward and down, following the contour of the deflector 44, past the apex 72 edge of the cutting blade 42 until the strip 24 reaches the pre-set distance signaled from the printed circuit board.

Figure 6:
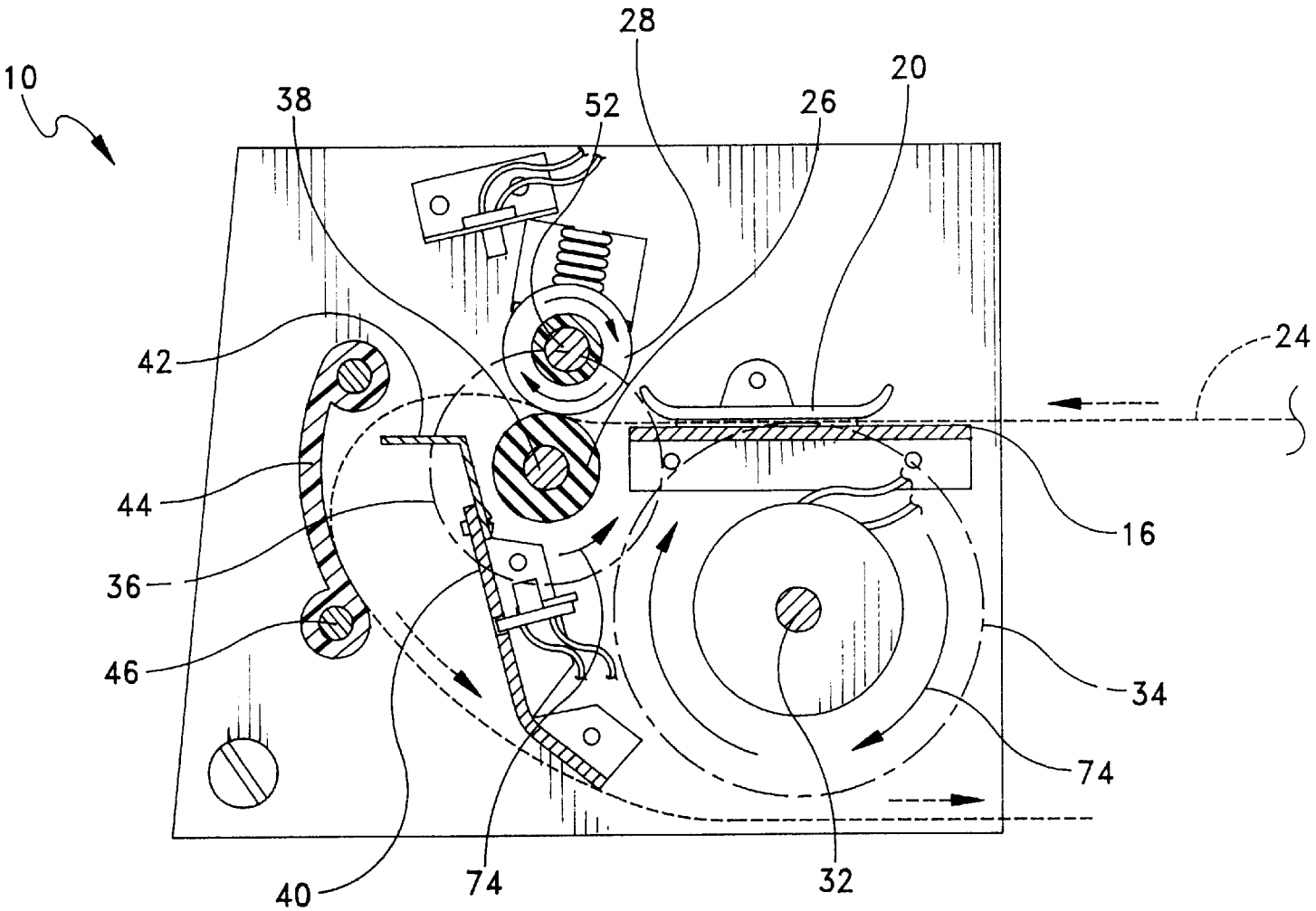
FIG. 6 is an enlarged view similar to that depicted in FIG. 5 showing the direction of rotation of the pinch rollers of the mechanism of the instant invention and forward advancement of the strip of lottery tickets therethrough.

Referring now to FIG. 6, direction of the gears 34 and 36 and pinch rollers 26 and 28 are indicated by arrows 74 in the drawing. Specifically, the motor 30 drives the gear shaft 32 to rotate the drive gear 34 in a clockwise direction. The drive gear 34 meshes with the driven gear 36 to rotate the first pinch roller 26 in a counter clockwise direction. The first pinch roller 26 has a urethane cover which engages the roller pads 60 of the second pinch roller 28 to rotate same in a clockwise direction. As depicted in FIG. 6 the strip of lottery tickets 24 is advanced through the mechanism 10 as described above.

Figure 7:
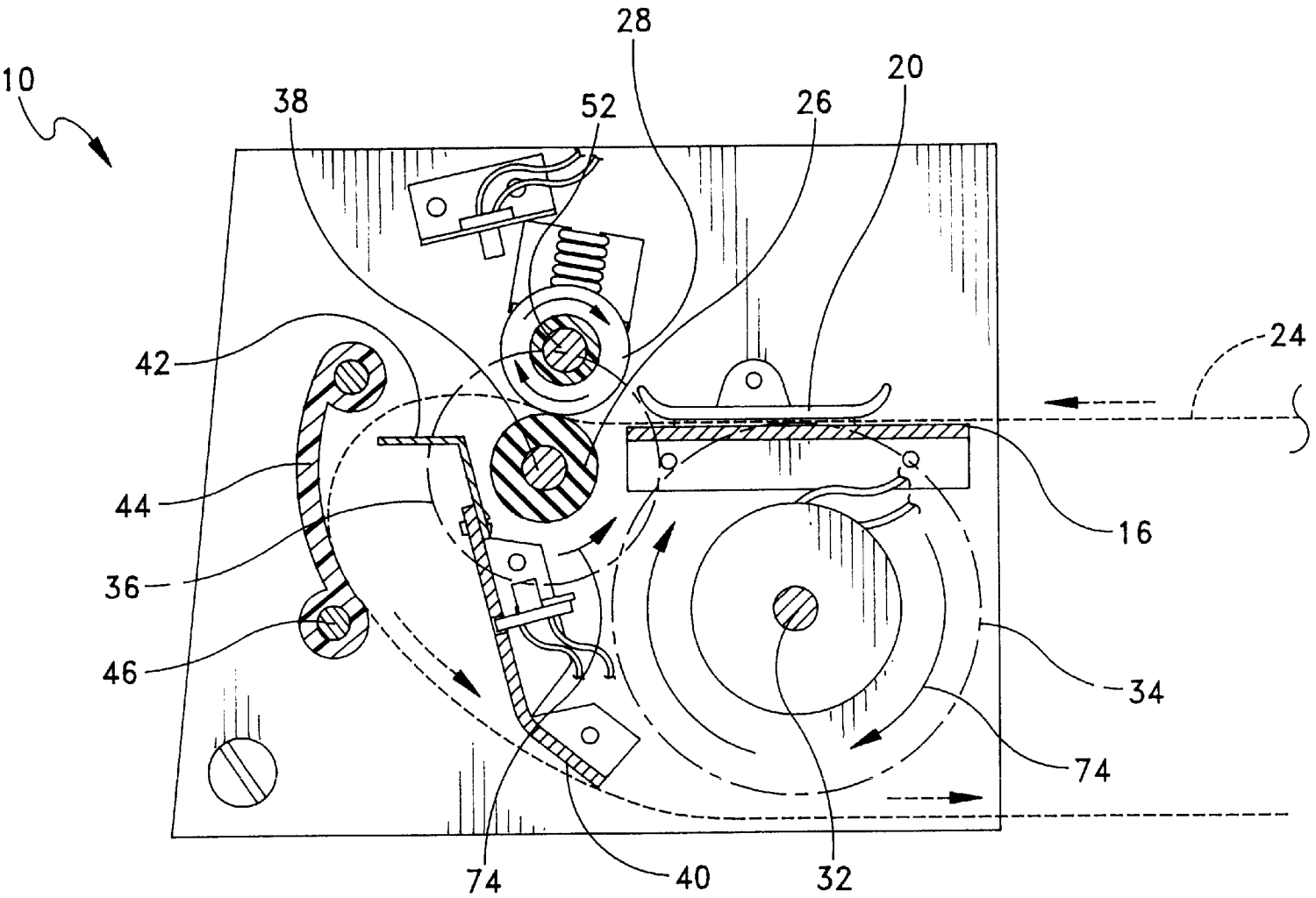
FIG. 7 is a similar view to that depicted in FIG. 6 showing further rotation of the gear driven pinch rollers and further forward advancement of the strip of lottery tickets therethrough.

Referring to FIG. 7, the lottery tickets 24 are advanced through the dispensing mechanism 10 as described above. Specifically, the strip of tickets 24 are further along in forward advancement than that depicted in FIGS. 5–6, but have not yet reached the pre-set distance generated from the printed circuit board. As shown in the drawing the tickets 24 advance through the mechanism over the stationary cutting blade and are deflected by the cover 44 sending the strip under the cutting blade plate 40 which is angled for unobstructed and controlled advancement of the strip towards the rear of the mechanism.

Figure 8:
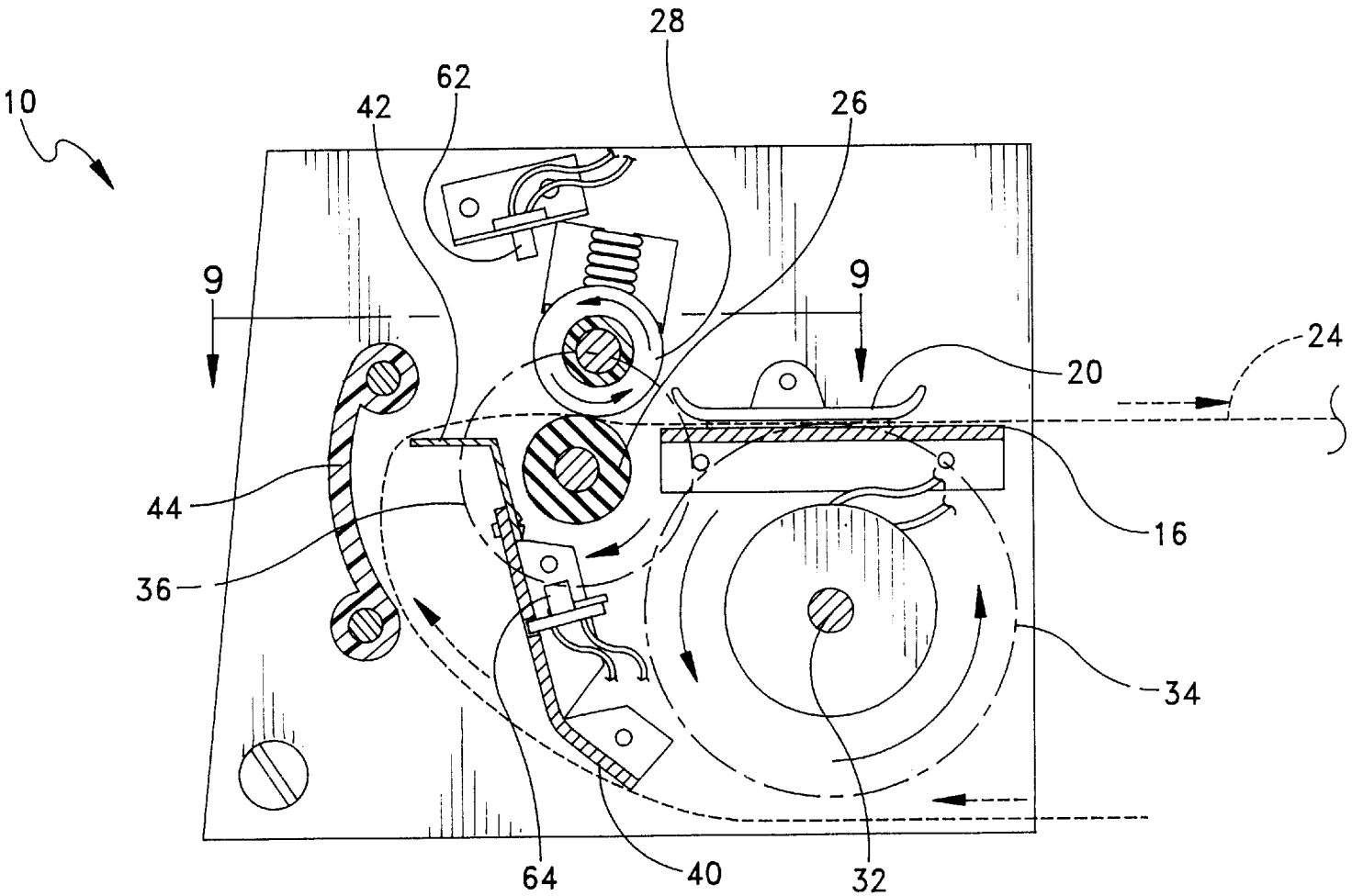
FIG. 8 is a similar view to that depicted in FIG. 7 showing the gear driven pinch rollers rotating in an opposite direction moving the strip of lottery tickets backwards through the dispensing mechanism.

Referring now to FIG. 8, the lottery tickets have reached the pre-set distance generated by the printed circuit board at which point the motor 30 reverses to send the strip of tickets 24 backwards towards the stationary cutting blade 42. Specifically, when the leading edge of the tickets 24 reach the pre-set distance, i.e., the desired number of tickets to be dispensed have passed the cutting blade, the optic sensors 62 and 64 detect same which sends a signal to the motor 30 to reverse direction. As shown, when the motor 30 reverses, the drive shaft 32 rotates the drive gear 34 in an opposite counter-clockwise direction which meshes with the driven gear 36 for rotation of the first pinch roller 26 in a clockwise direction and rotation of the second pinch roller 28 in a counter-clockwise direction which directs the strip of tickets 24 back towards the deflector cover 44 and stationary cutting blade 42. Specifically, the tickets 24 travel backwards through the gap located between the cutting blade 42 and deflector cover 44 and are pulled against blade 42 wherein the apex 72 of the stationary cutting blade 42 engages the first encountered perforation of the continuous strip 24 to penetrate same and then cause complete separation of the selected number of tickets therefrom.

Figure 9:
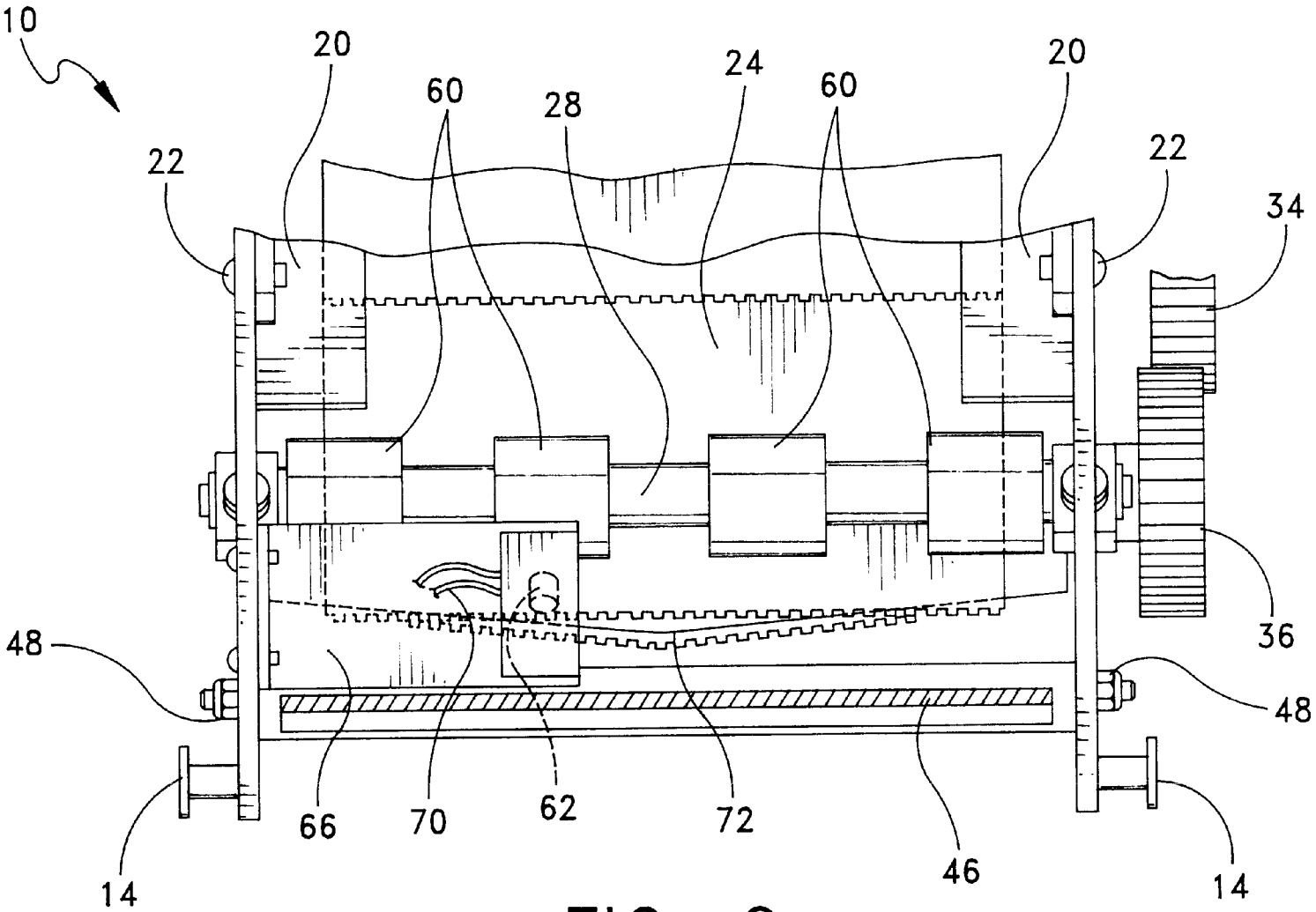
FIG. 9 is a cross-sectional view taken along line 9—9 of FIG. 8 showing the cutting blade of the mechanism of the instant invention separating the lottery tickets at a perforation of the continuous strip.

Referring to FIG. 9, the actual separation of the selected number of tickets at the apex 72 of the cutting blade 42 is more clearly depicted. Specifically, the apex 72, which is defined by opposite tapers of approximately 100–110°, penetrates through the strip 24 at the center of the selected perforation point, and as the motor 30 continues to operate in the reverse direction, it bursts or pull-separates the selected number of tickets from the strip 24 which are subsequently dispensed out of the bottom of the vending machine. After the selected number of tickets are dispensed from the machine, the motor 30 again reverses and the mechanism 10 returns to a home position. It should be understood that the apex of the edge of the cutting blade only comes into contact with the strip of tickets when the motor is operating in a reverse direction. In other words, when the motor is advancing the strip of tickets forward through the dispensing mechanism, the tickets ride over the stationary cutting blade and never come into contact with the apex cutting edge, but when the motor reverses, the arrangement is such that the first encountered perforation engages the apex of the cutting blade which first penetrates same, and then as the strip continues to be pulled rearwardly, causes complete tearing away of the selected number of tickets from the remainder of the strip in a smooth and effective operation. Also of critical importance, is the arcuate path through which the strip of tickets passes when fed by the pinch rollers, specific reference being made to the fact that when the strip engages the deflector 44, it is caused to reverse its direction as clearly illustrated in FIGS. 5–8. Thus, when motor 30 reverses, and the strip is pulled against the cutting blade 42, the strip is generally perpendicular to the cutting edge which promotes piercing of the perforation by apex 72.

Figure 10:
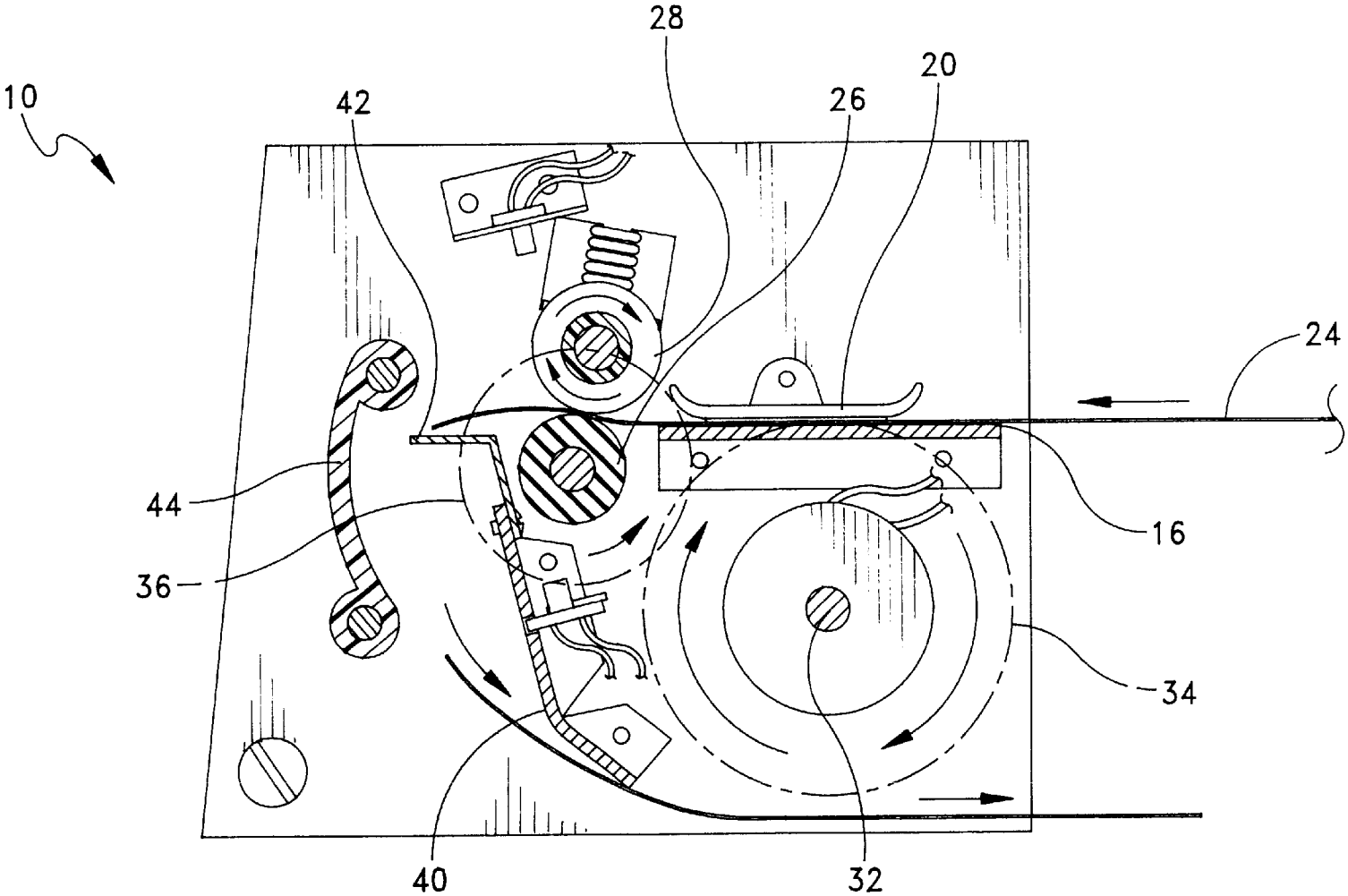
FIG. 10 is a similar view to that depicted in FIG. 7 showing a portion of the lottery tickets separated from the continuous strip.

Referring to FIG. 10, the tickets 24 have been separated from the strip and the mechanism 10 is in motion to return to the home position. As also shown in FIGS. 5–7, the motor 30 drives gear 34 in a clockwise direction which meshes with the driven 36 gear for rotation of the pinch roller shafts and advancement of the lottery tickets 24 to the home position.

It can therefore be seen that the instant invention provides for an effective vending machine that is selectively operable for automatically dispensing a predetermined number of instant scratch lottery tickets from the machines dispensing mechanism. The dispensing mechanism is controlled by a computer driven printed circuit board which sends the appropriate signals to a motor for advancing the continuous strip of perforated lottery tickets forward through a pair of pinch rollers and past a stationary cutting blade until the strip reaches a pre-set distance signaled from the printed circuit board, at which point the motor reverses itself sending the strip of tickets backwards engaging the stationary cutting blade for separation of the selected number of tickets from the continuous strip. The vending machine provides for an alternative sales outlet and easy access for prospective purchasers of instant scratch lottery tickets and may be located at any desirable public or private venue. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of dispensing a selected number of tickets perforated at intervals in a continuous strip, the method comprising:

generating a pre-set distance for the continuous strip of tickets to travel corresponding to the selected number of tickets to be dispensed;

feeding the continuous strip in a forward direction through a dispensing mechanism;

deflecting the continuous strip of tickets such that the strip of tickets passes by a stationary cutting blade in spaced relation thereto in the forward direction;

reversing the direction of the continuous strip of tickets such that the tickets move toward the stationary cutting blade in a backward direction;

drawing the continuous strip of tickets in the backward direction against the stationary cutting blade such that a first encountered perforation of the continuous strip is engaged by the stationary cutting blade; and continuing movement of the tickets in the backward direction until the blade has penetrated the first encountered perforation thereby cutting the selected number of tickets from the continuous strip.

2. The method of claim 1, wherein the dispensing mechanism includes a motor constructed and arranged to power advancement of the continuous strip of tickets in both the forward direction and the backward direction.

3. The method of claim 2, further comprising the step of detecting a leading edge of the strip of tickets as the strip moves in the forward direction.

4. The method of claim 3, further comprising the step of signaling the motor to reverse direction upon detecting that the leading edge of the strip of tickets has reached the pre-set distance.

5. The method of claim 1, further comprising the step of inputting the number of tickets to be dispensed.

6. The method of claim 5, further comprising the step of generating the pre-set distance from the number of tickets input.

7. The method of claim 1, wherein the tickets are deflected in an arcuate path in the forward direction by a deflector cover.

8. The method of claim 7, wherein the tickets are further deflected toward an output.

9. The method of claim 1, wherein the first encountered perforation is engaged by an apex of the stationary cutting blade.

10. The method of claim 1, further comprising the step of returning the continuous strip of lottery tickets which were not dispensed to a home position.

11. The method of claim 1, wherein the continuous strip of lottery tickets is drawn against the cutting blade in a generally perpendicular direction to a cutting edge of the stationary cutting blade.

* * * * *